United States Patent [19]

Schippers et al.

[11] 3,945,581

[45] Mar. 23, 1976

[54] HIGH-SPEED CROSS-WINDING DEVICE

[75] Inventors: Heinz Schippers; Erich Lenk, both of Remscheid, Germany

[73] Assignee: Barmag Barmer Maschinenfabrik Aktiengesellschaft, Wuppertal, Germany

[22] Filed: Jan. 17, 1975

[21] Appl. No.: 541,731

Related U.S. Application Data

[63] Continuation-in-part of Ser. No. 289,152, Sept. 14, 1972, Pat. No. 3,861,607.

[30] Foreign Application Priority Data

Aug. 14, 1970 Germany ..... 2040479

[52] U.S. Cl. ..... 242/43 R; 242/43.2

[51] Int. Cl.[2] ..... B65H 54/28; B65H 54/38

[58] Field of Search ..... 242/43 R, 43.2, 18 DD, 242/18.1

[56] References Cited

UNITED STATES PATENTS

| | | | |
|---|---|---|---|
| 1,926,049 | 9/1933 | Kelley | 242/43.2 |
| 1,928,365 | 9/1933 | Anderson | 242/43.2 |
| 2,646,227 | 7/1953 | Calhoun et al. | 242/43.2 |
| 2,664,249 | 12/1953 | Wright | 242/43 R |
| 2,736,506 | 2/1956 | Selby | 242/43.2 |
| 2,752,100 | 6/1956 | Stange | 242/18 DD |
| 2,969,198 | 1/1961 | Wolff | 242/43.2 |
| 3,089,657 | 5/1963 | Chaussy | 242/43 R |

FOREIGN PATENTS OR APPLICATIONS

| | | | |
|---|---|---|---|
| 1,005,880 | 4/1957 | Germany | 242/43.2 |
| 14,153 | 1906 | United Kingdom | 242/43.2 |
| 552,207 | 3/1943 | United Kingdom | 242/43 R |
| 728,529 | 4/1955 | United Kingdom | 242/43.2 |

*Primary Examiner*—Stanley N. Gilreath

*Attorney, Agent, or Firm*—Johnston, Keil, Thompson & Shurtleff

[57] ABSTRACT

High-speed cross-winding apparatus with two traverse motion devices for winding elongated materials, especially continuous filaments, into packages and embodying a reciprocable thread guide as a first traversing device, and a second traversing device in the form of a roller with spiral, thread-guiding grooves, the first and second traverse motion devices being driven synchronously, and a drive roller for driving the package being driven independently thereof. The grooves of the latter traverse roller have variable depth for winding tension uniformity, and may also temporarily accelerate stroke velocity above the stroke velocity of the first traverse device immediately before and/or after stroke reversal. The groove depth increases from the middle of the roller to a maximum depth preceding the stroke reversal point and then either (a) immediately and continuously decreases in depth or (b) immediately decreases, then increases and then again decreases in depth.

14 Claims, 7 Drawing Figures

FIG. 6
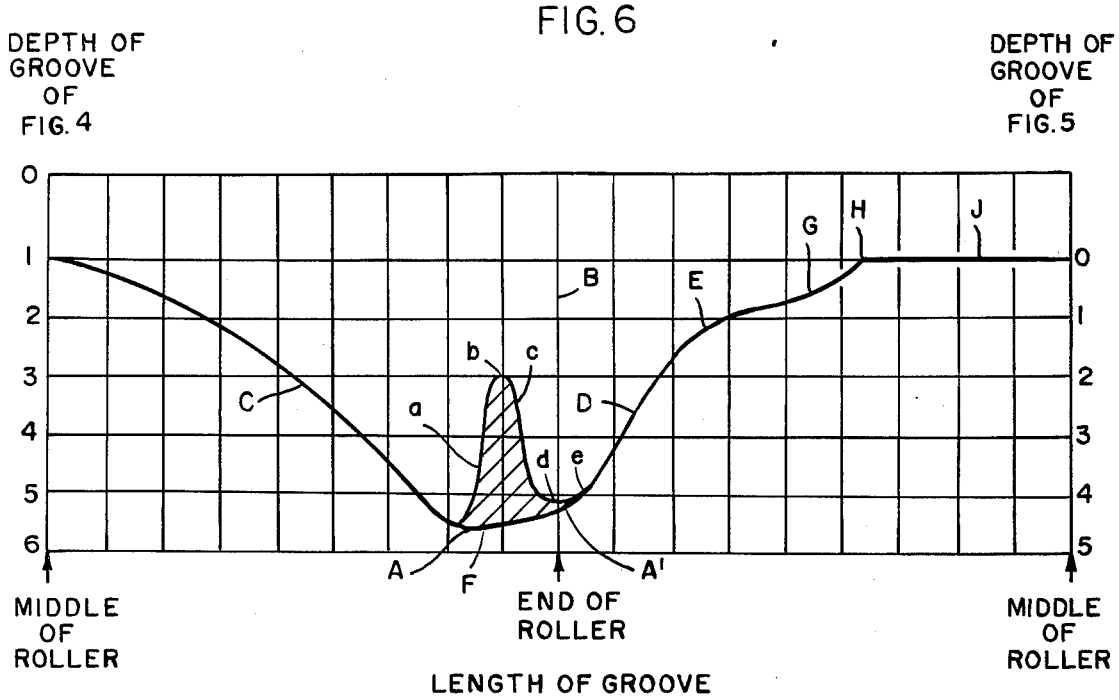
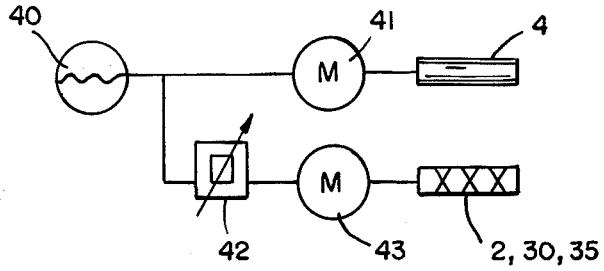
FIG. 7

HIGH-SPEED CROSS-WINDING DEVICE

RELATED APPLICATION

This application is a continuation-in-part of our copending application Ser. No. 289,152, filed Sept. 14, 1972, now U.S. Pat. No. 3,861,607.

THE INVENTION

It is the principal objective of the present invention to provide high-speed cross-winding devices capable of producing winding packages of cylindrical shape with substantially uniform tension of the thread throughout the winding package even when such winding is done at high speeds exceeding 2500 m/min. These high-speed winding devices are capable of producing cylindrical packages of substantially uniform thread tension throughout at high winding speeds up to about 3000 to 4000 m/min.

The improvements herein over the cross-winding devices of the aforesaid application reside principally in the contours of the variable depth of the thread-guiding groove of the second traverse device, a roller with spiral thread guide grooves of variable depth.

Briefly, the invention provides (1) a first traverse device having a reciprocable thread guide for guiding the thread, and (2) a second traverse drive comprising a roller having spiral, thread-guiding grooves. The stroke length of the first traverse device is approximately equal to the distance between the stroke reversal points of the grooves of the grooved traversing roller. The apparatus has a drive for said reciprocable thread guide. The drive preferably reciprocates the thread guide through the stroke reversal zones at low deceleration and acceleration while imparting, before and/or after stroke reversal, a velocity of said thread guide which is greater than the velocity thereof while it traverses said mid-range. Preferably, the drive is a reversibly spirally grooved roller, the groove of which at the sroke ends having before and/or after the stroke reversal point a pitch angle greater than the pitch angle in said mid-range and also a greater radius of curvature at said stroke ends i.e., greater than would be the radius of curvature at the stroke ends with grooves pitched at the pitch angle of the mid-range, if the stroke length of said first traverse device is approximately equal to the maximum distance between the stroke reversal points of the grooves of the second traverse device.

The second traverse device is a rotating thread guide roller with thread guiding, spiral grooves. The second traverse device of this invention may be a rotatable roller having spiral thread guide grooves which extend continuously in spiral fashion over the traverse length of the roller, or which may be interrupted at the mid-portion of the traverse roller. Both traverse devices run—except in the vicinities of the stroke ends—according to the same law of motion, but with a certain constant lead of the first thread guide in order to take into account the lag of the thread between the first and second traverse device. Through this constant lead it is assured that the thread upon entry and exit from the grooves of the second rotating traverse roller runs onward at a constant speed in the traverse direction and without change of the lag or distribution angle.

During the running of the thread in the second traverse arrangement in the vicinities of the stroke ends, the frist traverse device, i.e., the thread guide, however, follows a principle of motion peculiar to it, the objective of which is to keep as small as possible, through as small as possible changes of velocity, the inertia forces acting on the thread guide as it reverses direction.

These small changes in velocity were hitherto possible to realize only when the stroke of the thread guide is considerably smaller than the stroke of the second traverse devices, the spiral thread guide grooves. With this motion of the thread guide, it has been demonstrated that the thread, because of excessive deviation of its running direction from the thread guide groove direction, is occasionally pulled out of the thread guide groove. This occurs especially when—as provided according to a preferred embodiment of said application—the guide groove has immediately after the reversal point an increased pitch angle. Thereby there exists the problem of disturbances of the thread distribution and of thickenings or hard zones in the winding. These can lead to uneven engagement of the friction drive roller against the package, damage to the thread and to the slippage of the threads down end faces of the packages.

The thread guide grooves of the thread guide roller preferably extend spirally continuously over the length of the roller, or alternatively extend spirally from the longitudinal mid-portion of the roller to the respective stroke reversal zones at each end of the roller and thereafter return spirally to a terminus point short of the mid-portion of the roller. These spiral grooves have a special variable depth wherein the depth increases progressively from the mid-portion of the roller to a maximum depth at a point preceding the place of stroke reversal of such grove. In a first embodiment, the depth immediately decreases from said point at a rate less than the rate of increase immediately preceding said point to a point immediately preceding, at or beyond the point of stroke reversal of the groove.

The next portion of the groove following the stroke reversal point preferably decreases at a rate of inclination more sharply than the rate of increase of depth of the portion of the groove between the mid-point of the roller and the aforesaid maximum depth. After this more sharp rate of decrease in depth of the thread groove, the rate of decrease of depth is at a lesser value than the sharp rate of decrease to the terminus point of the end of the groove or to mid-point of the roller, the latter being applicable to the embodiment with a continuous, uninterrupted spiral groove.

In a second embodiment, the depth of the groove similarly increases progressively from the mid-portion of the roller to a maximum depth at a point preceding the place of stroke reversal of the groove. At said point, the groove depth immediately sharply diminishes to a second point also preceding the place of stroke reversal. At the second point, the groove depth again begins to increase to a third point having a depth less than the depth of the first point. The third point is substantially at the place of stroke reversal. At the third point the groove resumes its decrease in depth, which continues until the groove reaches its shallowest depth or merges with the cylindrical surface of the roller.

It is important to maintain a low friction between the grooves and the thread running therein and also between the cylindrical surface of the roller and the thread running thereover. The grooved roller constituting the second traverse device preferably runs at a peripheral velocity which is greater than the peripheral velocity of the drive roller which rotates the winding package. The drive roller, on the other hand, has a higher friction with the running thread and with the thread on the winding package. These differences in friction are attained by differences in the character of the surface of the rollers and the walls of the grooves. The higher friction is attained by polishing the surface of the drive roller, while the surface and walls of the grooves of the traversing roller have a matte finish.

The thread runs over the grooved roller in a manner wherein the contact arc between the running thread and the grooved roller is at least 60°, preferably about 90°. This contact arc, coupled with the independently controlled peripheral velocity of the grooved roller and its matte finish for providing a low co-efficient of friction with the thread running thereover, facilitates control of the uniformity of the desired tension of the thread running off the grooved roller onto the winding pckage. The latter is driven by the higher friction drive roller at a predetermined constant peripheral velocity of the package by a separate drive for the friction drive roller. By the capability to adjust the tension of the thread portion running from the grooved traversing roller onto the winding package through varying the peripheral velocity of the low friction, grooved traversing roller, the thread manufacturer or processor may select, depending upon the particular requirements, a tension for such thread portion, which is:

1. greater than the thread tension of the portion running between the thread delivery device (e.g., a godet) and the low friction, grooved traversing roller by using a peripheral velocity of the latter which is less than the peripheral velocity of the drive roller;

2. the same tension by using equal peripheral velocities; or 3. a lesser tension by using a greater peripheral velocity of the grooved traversing roller.

As the thread proceeds in its traverse path from the mid-portion of the grooved, thread-traversing roller toward the stroke reversal zone, there is an increasing tendency toward a tension build-up in the running thread, particularly at the stroke reversal zones. To overcome this problem, it is preferred, in accordance with certain embodiments of the invention, to utilize the variable depth grooves as afore-described. Such variable depth grooves, particularly in combination with higher peripheral velocity of the grooved, thread-traversing roller than the peripheral velocity of the drive roller, and the lower friction finish of its cylindrical surface and the walls of the grooves, enable the winding of cylindrical packages without hard ends and with substantially uniform tension at velocities even exceeding 3000 m/min. As is known in the art, such variable tensions of the thread in the winding package lead to subsequent technical difficulties in dyeing or other processing of the thread, to cylindrical packages with hard ends, and poor laying of the superposed winding layers on the winding package.

The controllable peripheral velocity of the grooved transverse roller, particularly one with the variable depth of the spiral crossing grooves, enables the winding at high winding speeds of 1500 to about 4000 m/min without serious tension fluctuation during the traverse stroke, which may reach 600 m/min. With known winding devices operating at high winding speeds, such uncontrolled tension and tension build-up or break-down changes would cause the running thread to climb up out of the spiral grooves, particularly in the traverse stroke reversal zones, and/or take the path of the oppositely spiralled groove at the groove crossing points.

An advantage of the invention lies in that it makes it possible to keep the speed changes of the thread guide in the reversal places within suitable limits, but nevertheless, to adapt the thread guide stroke to the stroke length between the thread guide grooves. Through this adaptation of the movements of the thread guide to those of the thread guide grooves it becomes possible to construct the thread guide grooves in such a way as is required for the even distribution and, in particular, for the exact reversal of the thread in the package edges without danger that the thread guide grooves will lose the thread.

THE DRAWINGS

In the following description, the invention is illustrated by preferred embodiments illustrated herein, wherein.

Figure 5:
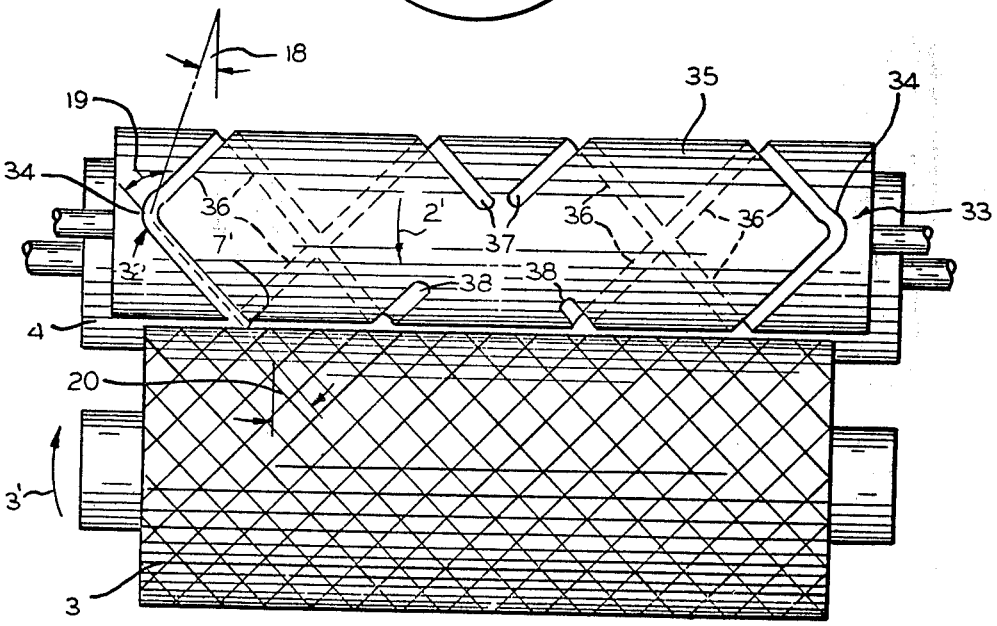

FIG. 5 is a front elevation of a third embodiment of the invention in which the second traversing device comprises a spirally grooved roller in which the entrant portion of the respective spiral crossing grooves begins in the longitudinal mid-portion of the roller, continues through the thread reversal zone near the respective ends of the roller, and terminates its reversely spiralled portion short of the longitudinal mid-portion of the roller;

FIG. 6 is a diagram of embodiments of the variable depths of the spiral groove plotted with the length of the spiral groove illustrated in linear dimension as the abscissa and the variable depth of the groove plotted as the ordinate; and FIG. 7 is a diagrammatic view of an electric motor drive for the package drive roller and for the two traversing devices.

THE ILLUSTRATED EMBODIMENTS

Figure 1:
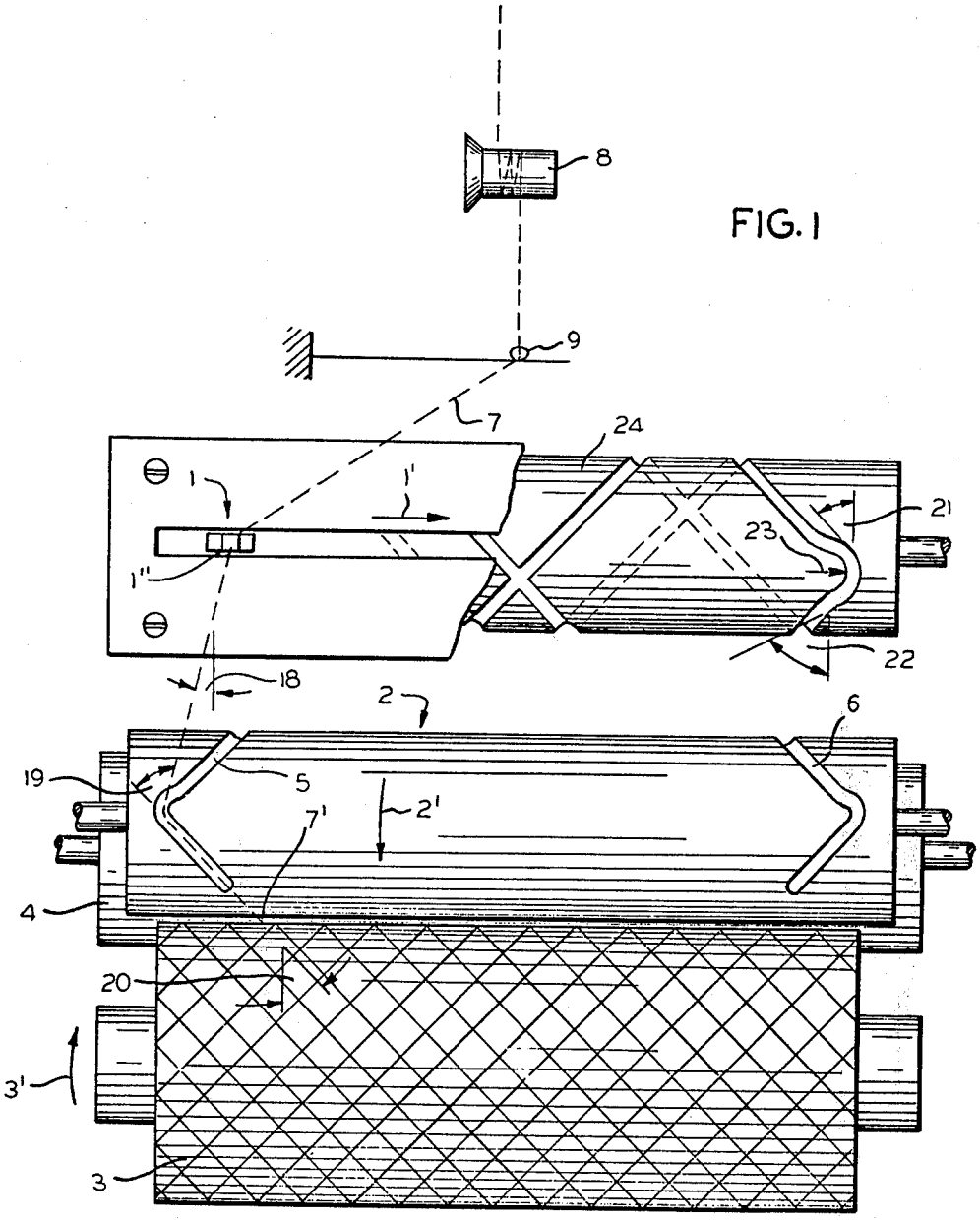
FIG. 1 is a front elevation of the traverse devices, the drive roller, and the winding package with the thread thereon.

The first traverse device is a thread guide 1, which in FIG. 1 has the instantaneous direction of movement 1' and is driven by the reverse thread roller 24. The second traverse device is a parallel cylinder or roller 2 with the thread guide grooves 5 and 6 at the stroke ends. The roller 2 has the direction of rotation 2'. The thread 7 coming from the delivery mechanism 8 or directly from the spinning nozzles (not shown) through the fixed thread eye 9 is guided in the zone of the traverse stroke ends over the thread guide 1 into the groove 5 and from this onto the winding package 3, which is driven by drive roller 4 in the direction of rotation 3'.

In the process there occur the following angles:

The lag angle 18 is the angle formed by the thread portion between thread guide 1 and thread guide groove 5 or 6. The angle 19 is that between thread 7 and thread guide groove 5 or 6. The distribution angle 20 is that formed by the thread running onto the winding package.

Figure 2:
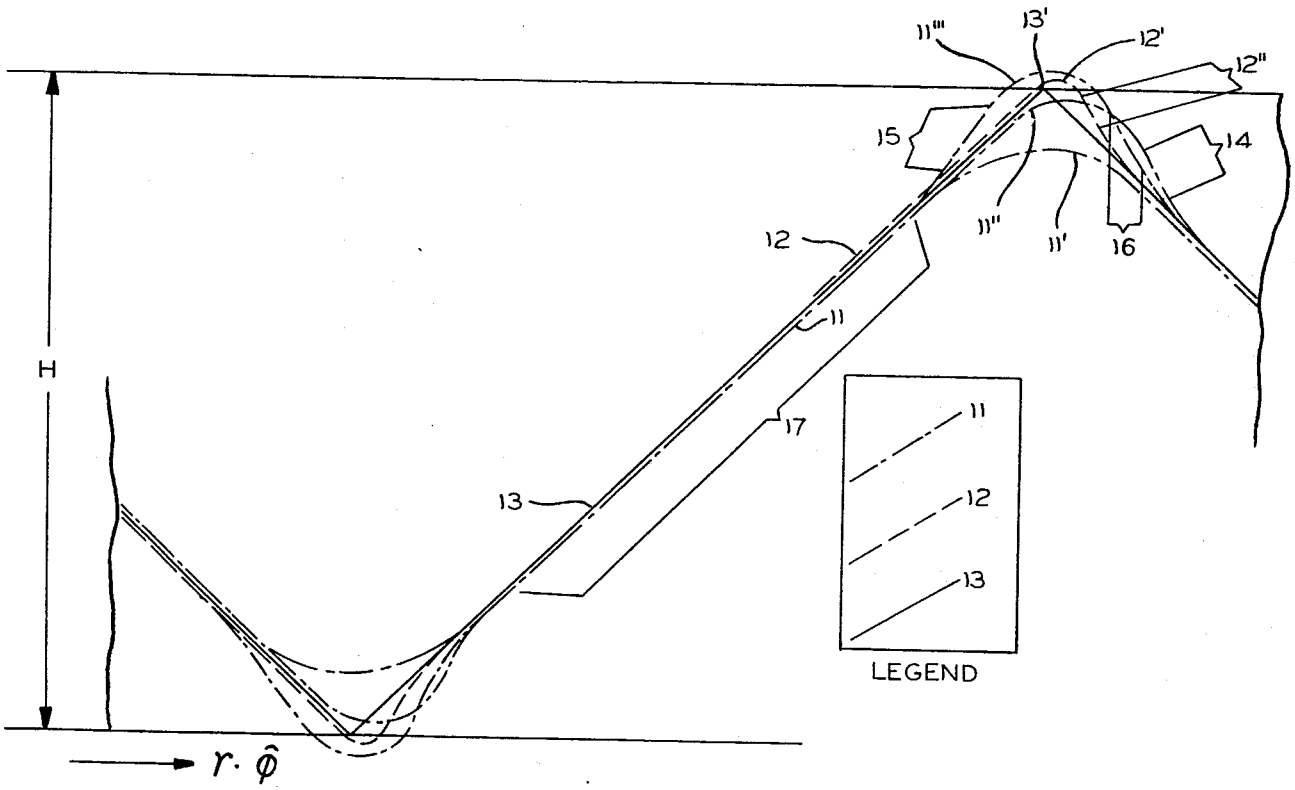
FIG. 2 is a graphic projection of the movement of the traverse devices and the distribution of the thread onto the package, the ordinate being the stroke (H) and the abscissa being the development $\gamma.\phi$.

The curves 11, 12, 13 of FIG. 2 represent the movement of the thread guide 1, of the thread guide grooves 5 and 6 and of the run-on point 7' of the thread 7 onto the package 3. In principle, all the movements, except in the zones of the stroke ends, follow the same laws of motion with a phase displacement in time. The underlying requirement for the avoidance of irregularities in the windings with respect to hardness and thickness is the maintenance of the sharp cornered curve 13 for the run-on point 7' of the thread 7 onto the package 3 as exactly as possible during reversal of the thread at the reversal point 13'.

In order to bring about this exact reversal of the thread, the aforesaid application provided that the thread guide grooves 5 and 6 do not reverse at point 13' but, in correspondence to the curve 12, had an overstroke 12' and thereupon an increased pitch angle 12''. The thread guide 1 cannot follow the principle of motion along curve 13 in the zone of the stroke ends, since then there would occur inadmissibly high inertial forces resulting from the sudden decelerations or accelerations. For this reason, the thread guide 1 in a typical thread guide drive reverses with only slight delay or acceleration in correspondence to the curve 11'. Through the overstroke 12' of the thread guide grooves 5 or 6 on the one hand, and through the gentle reversal 11' of the thread guide 1 on the other hand, however, the angle 19 (FIG. 1) between the running thread 7 and the thread guide groove 5 becomes so great that the thread is easily pulled out of the groove.

In order to avoid this, the thread guide drive according to this invention follows, in an example of execution, the curve 11'' which is distinguished besides by small delay of accelerations at its stroke reversal points, by a stroke length increase with respect to the curve 11' and an increased velocity in the zone 14 after the reversal of the stroke for the reattainment of the synchronous traverse movements of the traverse devices 1 and 2 and of the thread in the middle stroke range 17. It is likewise possible to maintain an increased velocity analogously to 14 only in the zone before the reversal.

Another possible example uses for the thread guide drive a principle of movement according to curve 11'''. This is distinguished, besides by a still less rate of deceleration or acceleration at the stroke reversal places, by the increased velocities in the zones 15 and 16 before and after stroke reversal.

In all cases, through the temporarily increased velocity of the thread guide, it becomes possible to adapt its stroke to the stroke of the second traverse device despite low acceleration or deceleration values in the reversal zone, in which system its stroke there can be greater or smaller than the stroke of the thread guide grooves 5 or 6.

The temporarily increased velocities of the thread guide 1 are achieved, in the case of drive by the reverse thread roller 24, by the increased pitch angles 21 and 22 of the reversal thread. This simultaneously makes possible an increase of the radius of curvature 23 to provide a reduction of the velocity change at stroke reversal. One or both of the increased pitch angles 21 and 22 may be used at the stroke ends to provide before and/or after the stroke reversal point a pitch angle greater than its pitch angle in said mid-range and also a greater radius of curvature at said stroke ends.

Figure 4:
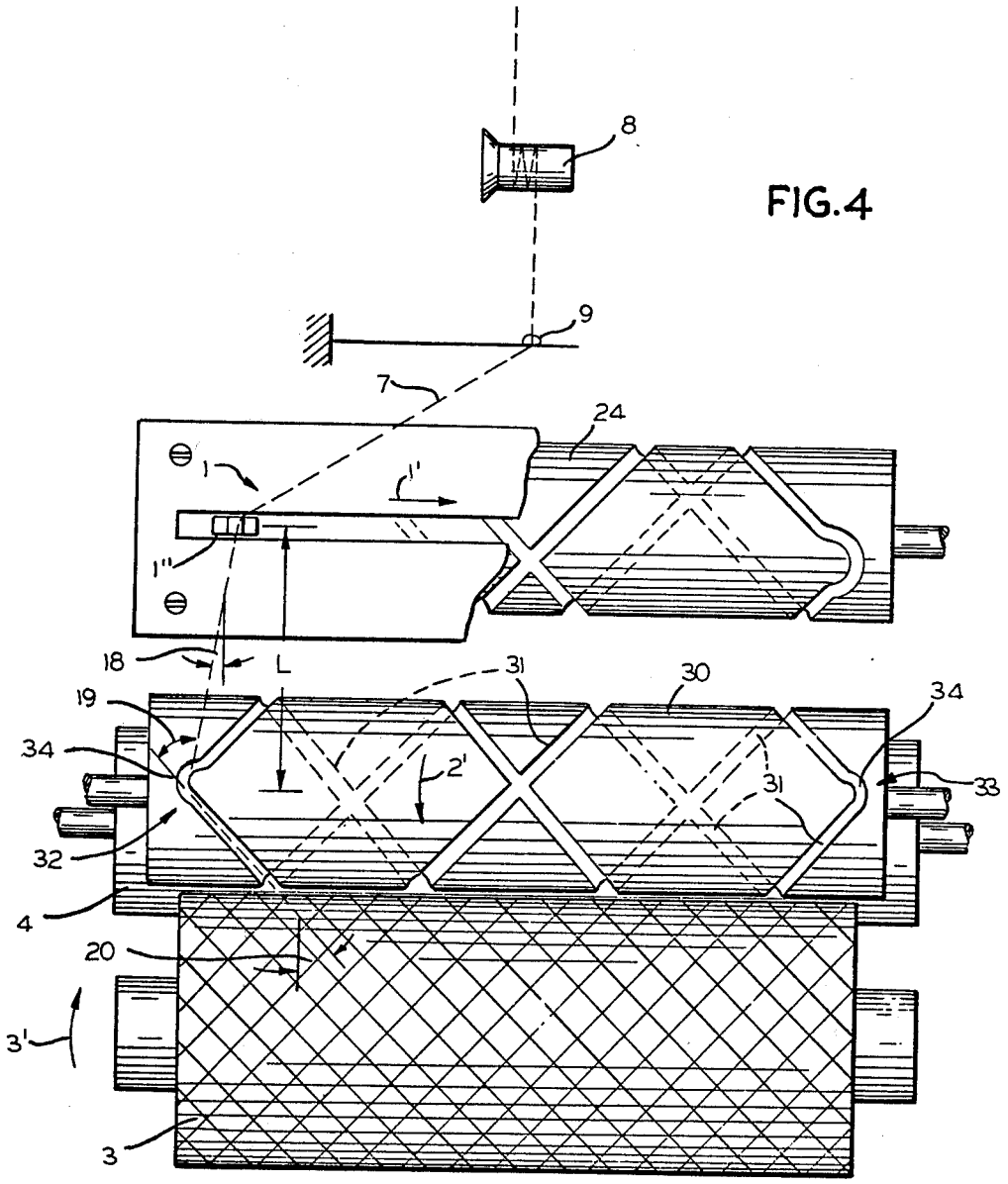
FIG. 4 is a front elevation of a second embodiment of the invention wherein the second traversing device comprises a spirally grooved roller with continuous, spiral crossing grooves.

Referring now to FIG. 4, this embodiment is similar to the embodiment of FIG. 1 with the exception of the character of the spiral grooves in the second, thread-traversing roller 30. Where applicable, like numerals designate like parts of the winding apparatus. The roller 30 has a continuous, cross-spiral groove 31 extending substantially its entire length. The thread 7 runs first through the reciprocating guide 1'' of the first traverse device. The guide's reciprocal movement of the thread leads the reciprocal movement of the thread in the continuous groove 31 to provide the lag angle 18, which will lay the thread at the proper angles for guidance thereof in the portion of groove 31 in which the thread is positioned at any given time. The thread reversal zones 32 and 33 have a configuration similar to the corresponding thread reversal zones of the embodiment of FIG. 1 in plan view. The grooves 31, however, have a variable depth over the length thereof. The variable depth-length relationsip is illustrated in FIG. 6. The ordinate applicable to the embodiment of FIG. 4 is the lefthand ordinate of FIG. 6 wherein the zero reference line indicates the surface of the roller 30 and the 1 reference line indicates the depth of the groove at the middle of the drum. As can be seen from FIG. 6, the respective cross-spiral grooves, beginning in the longitudinal middle of the roller, deepen progressively to a maximum depth at point A, which precedes the place of stroke reversal of the thread (designated by the line B) at the end of the roller. The groove contour between the point A and the stroke reversal zone may have a variable depth pattern shown in FIG. 6, which is later described. The respective points of reversal of the thread traverses are the curved apices 34 (FIG. 4).

After the stroke reversal zone, the depth of the thread 31 decreases at a sharper rate of change or inclination than the progressive rate of change or inclination for the increasing depth indicated by the curve portion C of FIG. 6. This is shown in FIG. 6 by the curve portion D which has a greater inclination than does the curve portion C. The more sharply inclined portion D preferably continues to a point E wherein the depth of the groove is about 20 – 40% of the maximum depth of the groove, whereafter the groove further decreases in depth at a more gradual rate of decrease indicated by the curve segment G. This more gradual rate of decrease of depth preferably terminates at a point H laterally of the longitudinal middle of the roller; thereafter the depth remains constant to the middle of the roller, as indicated by the curve portion J.

The embodiment of FIG. 5 is similar in most respects to the embodiments of FIGS. 1 and 4. Where applicable, like numerals designate like parts. The principle difference of the embodiment of FIG. 5 with respect to the previous embodiments lies in the length of the spiral groove of the roller 35 constituting the second traversing device. Here the spiral grooves 36 respectively have beginning points 37 (points of thread entry) at the longitudinal mid-portion of the roller. These grooves 36 proceed spirally toward the rspective ends of the roller 35 through the thread reversal zones 32 and 33, and return in opposite spirals in a manner similar to the embodiment of FIG. 4. The returning portions of the spiral grooves 36, however, have terminus points 38 spaced laterally from the longitudinal mid-portion of the roller. As can be seen in FIG. 5, the portions of the groove constituting the beginning points 37 are in alignment with the portions of the respective grooves comprising the terminus points 38. This is done to accomplish take-over of the thread traverse motion by the beginning points 37 when the thread is in or has just exited from the terminus points 38.

In FIG. 6, the depth of groove has the righthand index for the embodiment of FIG. 5. Here, the respective cross-spiral grooves proceed in the illustrated depth-length relationship from the actual surface of the roller 35 and back to the actual surface designated by the number 0. The curve of FIG. 6 applicable to this embodiment includes all curve portions except the portion J—the terminus points 38 corresponding to point H in FIG. 6. The left hand index applies to the continuous groove of the roller 30, wherein the minimum depth (index = 1) is below the roller's cylindrical surface (index number = 0).

Between curve portions C and D in FIG. 6, the groove for the embodiments of FIGS. 4 and 5 may have two alternative types of contours. In the first type, the depth contour follows the path F between points A and A'. Here the groove reaches its maximum depth at point A before the stroke reversal point and immediately begins to decrease its depth at a rate of decrease shown by path F at rate less than the rate of increase of depth in the portion C of the depth contour. This decrease in depth continues to the approximate stroke reversal point of the groove, where its contour changes to a sharper rate of decrease of depth in order to merge smoothly with the contour segment D beginning at about A'.

In the second type of groove contour shown in FIG. 6, the depth contour follows the path *a*, *b*, *c*, *d*, *e* between the curve portions C and D. Here, point A is again the point of maximum depth and precedes the stroke reversal point of the groove. Here the depth increase (C) quickly is reversed to a sharp rate of decrease designated by the curve portion *a*. The decrease in depth continues to point *b*, located before the point of stroke reversal. The depth of the groove at point b is about 15–60% of the groove depth at point A.

At point b, the depth of the groove again increases at a relatively sharp rate along the curve path *c* similar to the rate of increase of the portion of curve path C which is adjacent point A. The depth increase continues to point *d*, the depth of which is about 60–90% of the depth of point A. Point d preferably is just before, at or just after the point of stroke reversal (End of Roller, FIG. 6). At point *d*, the groove depth again begins to decrease along the curve path *e* until it merges smoothly with the sharply depth-decreasing curve portion D.

The embodiments encompassed by FIGS. 4–6 thus are:

1. a spirally grooved thread guide roller 30 or 35 having spiral grooves of opposite hand for guiding the thread in traverse strokes thereof and stroke reversal zones at respective opposite ends of the roller, the spiral grooves having a variable depth which increases progressively from a shallowest segment at or below the surface of the roller in the longitudinal mid-portion of the roller to a point of maximum depth preceding the point of stroke reversal of the respective stroke reversal zones, and the respective spiral grooves then immediately decreasing in depth at a small rate of decrease to about the point of stroke reversal, and thereafter decreasing in depth at a rate of decrease greater than said small rate to a shallowest groove depth in the longitudinal mid-portion of the roller; and said spiral grooves either being (a) continuous, crossing grooves having their shallowest segments at the longitudinal mid-portion of said roller or (b) respectively beginning at the cylindrical surface of the longitudinal mid-portion of said roller and ending on the cylindrical surface of said roller at said point laterally displaced from the longitudinal mid-portion of said roller.

2. a spirally grooved thread guide roller 30 or 35 having spiral grooves of opposite hand for guiding the thread in traverse strokes thereof and stroke reversal zones at respective opposite ends of the roller, grooves in the cylindrical surface thereof, the spiral grooves having a variable depth which increases progressively from a shallowest segment at or below the surface of the roller in the longitudinal mid-portion of the roller to a point of maximum depth preceding the point of stroke reversal of the respective stroke reversal zones, which depth then decreases from said first-mentioned point to a second point preceding said point of stroke reversal, then again increases to a point substantially at the point of stroke reversal, and then again decreases to a shallowest groove depth in the longitudinal mid-portion of said roller; and said spiral grooves either being (a) continuous, crossing grooves having their shallowest segments at the longitudinal mid-portion of said roller or (b) respectively beginning at the cylindrical surface of the longitudinal mid-portion of said roller and ending on the cylindrical surface of said roller at said point laterally displaced from the longitudinal mid-portion of said roller.

Groove depth contours of the type shown by curve C, A, F, A', D, etc., (FIG. 6) are preferred for grooved guide rollers 30 or 35 which have a thread-traverse stroke length of about 150 mm. or more, e.g., up to about 350 mm. Groove depth contours of the type shown by curve C, A, *a*, *b*, *c*, *d*, *e*, D, etc. (FIG. 6) are preferred for spirally grooved guide rollers 30 or 35 which have a shorter thread-traverse stroke length, e.g., up to about 100 mm. For grooved guide rollers 30 or 35 having a thread-traverse stroke length of about 100–150 mm, the groove contour adjacent the stroke reversal point preferably has a curve lying within the shaded area of FIG. 6 between the two aforesaid curves.

The aforesaid embodiments of the rollers 30 and 35 preferably are used in high speed winding systems in combination with another traverse device having a reciprocable thread device for guiding the thread in traversing winding strokes, the latter traverse device being the first traverse device through which the thred runs. The first traverse device has means for reciprocably driving said thread guide to provide reciprocable movement of the guided, running thread in leading relationship to the reciprocable movement of the thread in said spiral grooves to provide a lag angle to lay the thread at proper angles for guidance in the respective portion of the spiral groove in which the thread is positioned at any given time during the traverse movement of the running thread by the reciprocating thread guide and said spiral grooves of said rotating, cylindrical, traverse roller. The first traverse device preferably has its thread guide reciprocably driven by drive means embodying a rotatable cross-spiral grooved roller, the groove of which at the stroke ends having before and/or after the stroke reversal point a pitch angle greater than the pitch angle in said mid-range and also a greater radius of curvature at said stroke ends.

The walls of said spiral grooves and/or said cylindrical surface of said roller preferably have a matte finish with a depth of roughening in said matte finish of about 1.5 to 40 microns, most preferably 3 to 10 microns.

The cylindrical surface of the thread-traversing rollers 2, 30 and 35 have a relatively low friction on the thread running thereover. This relatively low friction is attained by a matte surface for both the cylindrical surface of the rollers and the walls of the grooves therein. Such surfaces, for example, may be the so-called "matte-chromed" surfaces obtained by sand blasting the surfaces a predetermined depth of roughness and then hard-chroming this roughened surface. The depth of roughening of such matte-chromed surfaces generally amounts to said 1.5 to 40 microns, preferably about 3 to 10 microns. The package drive roller 4, on the other hand, has a higher friction with reference to the running thread and to the thread on the package, such as may be attained by using a highly polished chrome, cylindrical surface on this roller.

FIG. 7 illustrates a preferred form for the drive of the two thread traverse devices and the package drive roller. The drive comprises a common source of alternating current 40, a synchronous motor 41 for driving the drive roller 4, a rotary transformer 42, and a synchronous variable speed motor 43 for driving the spirally grooved roller 2, 30 or 35. The cross-groove roller 24 for the first traverse device is driven synchronously with the grooved rollers 2, 30 and/or 35, e.g., by means of a toothed belt-pulley connecting drive. The synchronous motor 41 drives the drive roller 4 fro the package 3 at a constant speed of rotation. The electrical energy for the synchronous motor 43 is also supplied by the source of alternating current 40, but via the rotary transformer 42. The rotatable part of the latter is periodically oscillated by an auxiliary drive, not shown. This brings about a periodic shift in the frequency of the current supplied to the synchronous motor 43, the speed of rotation of which consequently periodically oscillates briefly above and below its mean or average value. The speed of rotation of the grooved rollers of the traversing devices within thereby changes accordingly. This results in similar changes in the stroke velocities imparted to the thread by the thread-traversing devices, thereby eliminating or avoiding ribboning or mirror-image formations on the winding package.

Figure 3:
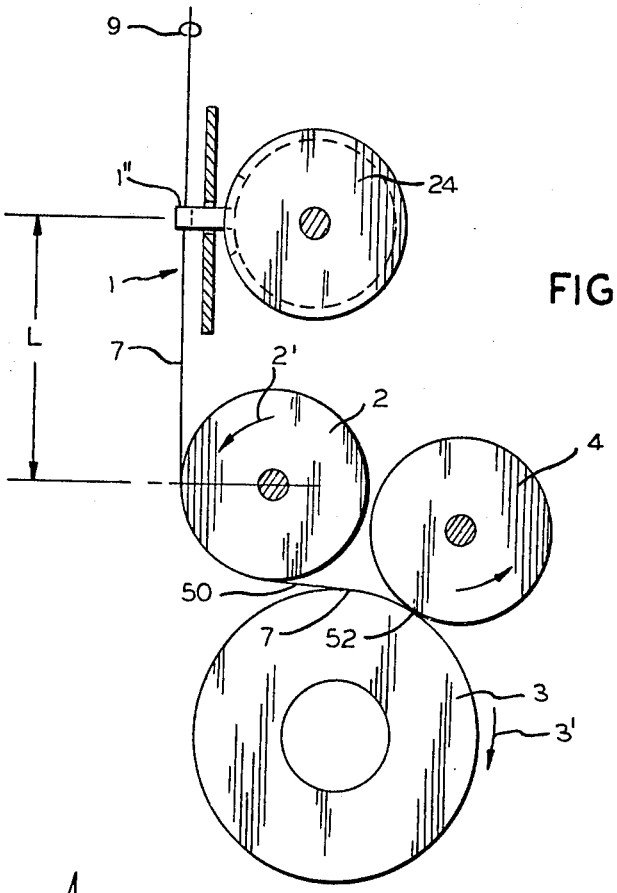
FIG. 3 is a side elevation of the winding device of FIGS. 1, 4 and 5, with the omission of the thread delivery godet shown in FIG. 1.

The rate of rotation, and hence the peripheral velocity, of the thread-traversing rollers 2, 30 and/or 35 can be controlled independently of the rate of rotation, and hence peripheral velocity, of the drive roller 4 by virture of their drive by separate motors. It is preferred, in order to attain uniform and desired thread tension in the thread package 3 and in the segment 50 of running thread (FIG. 3), to drive the spirally grooved roller 2 at a slightly higher peripheral velocity than peripheral velocity of the roller 4. Furthermore it is possible to change by controlling of the rate of rotation of the thread-traversing rollers 2, 30 and/or 35 also the distribution angle 20. The deviation of the peripheral velocity of the thread-traversing rollers 2, 30 and/or 35 to the peripheral velocity of the drive roller can be approximately ± 17% without the danger that the thread will climb out of the grooves of the second traverse device. By the same velocity of thread and surface of the spiral grooved roller the distribution angle 20 was 8°30′ and could be varied between 7° and 10° by changing the peripheral velocity of the spiral grooved roller. It is to be further noted from FIG. 3 that the thread runs onto and contacts the winding package 3 at a point 7′ prior to the point of contact 52 between the cylindrical thread package and the surface of the drive roller 4. This pre-contact of the thread with the winding package seats the thread in the package prior to its contact with the polished, high friction surface of the drive roller 4. Such high friction surface would otherwise tend to carry the running thread on its surface beyond the point of contact 52, and result in a progressively greater looping in the thread beyond the point of contact 52, particularly in cases where the tension of the thread running onto the package is low. In the arrangement shown, the friction between the running thread and the thread of the winding layers of the package is greater than the forces tending to carry the thread on the surface of the roller 4 beyond the point of contact 52, so that the thread is laid uniformly and at substantially constant tension on the winding package.

The two traverse devices and friction drive roller preferably are mounted on the same frame or unit and together are movable as a single unit up and down relative to the winding bobbin, its spindle or shaft and the bobbin winding thereon. The single unit in turn is vertically operated by a piston and cylinder unit with a diaphragm seal. The piston and cylinder unit in turn is operated under the control of a pneumatic (or hydraulic) control system to (a) regulate or control the contact pressure between the drive roller and the bobbin winding, (b) raise the unit at the end of the winding operation to allow the wound bobbin to be removed and (c) lower the unit to drive-operating position for the beginning of a new bobbin winding. A preferred form for this purpose and function is that disclosed in German Published Application No. P 20 39 772, published Mar. 2, 1972.

The invention is hereby claimed as follows:

1. A high speed winding apparatus comprising a traverse device, said traverse device being a rotatably driven, cylindrical, traverse roller with spiral grooves in the cylindrical surface thereof, said spiral grooves being of opposite hand for guiding the thread in traverse strokes thereof and having stroke reversal zones at respective opposite ends of the roller, the spiral grooves having a variable depth which increases progressively from a shallowest segment at or below the surface of the roller in the longitudinal mid-portion of the roller to a point of maximum depth preceding the point of stroke reversal of the respective stroke reversal zones, and the respective spiral grooves then immediately decreasing in depth at a first rate of decrease to about the point of stroke reversal, and thereafter decreasing in depth at a rate of decrease greater than said first rate to a shallowest groove depth in the longitudinal mid-portion of the roller.

2. A high speed winding apparatus as claimed in claim 2, said spiral grooves being continuous, crossing grooves having their shallowest segments at the longitudinal mid-portion of said roller.

3. A high speed winding apparatus as claimed in claim 1, embodying in combination with said traverse device another traverse device having a reciprocable guide for guiding the thread in traversing winding strokes, the latter traverse device being the first traverse device through which the thread runs, and means for reciprocably driving said thread guide to provide reciprocable movement of the guided, running thread in leading relationship to the reciprocable movement of the thread in said spiral grooves to provide a lag angle to lay the thread at proper angles for guidance in the respective portion of the spiral groove in which the thread is positioned at any given time during the traverse movement of the running thread by the reciprocating thread guide and said spiral grooves of said rotating, cylindrical, traverse roller.

4. A high speed winding apparatus as claimed in claim 1, embodying in combination with said traverse device another traverse device having a reciprocable thread device for guiding the thread in traversing winding strokes, the latter traverse device being the first traverse device through which the thread runs, and means for reciprocably driving said thread guide to provide reciprocable movement of the guided, running thread in leading relationship to the reciprocable movement of the thread in said spiral grooves to provide a lag angle to lay the thread at proper angles for guidance in the respective portion of the spiral groove in which the thread is positioned at any given time during the traverse movement of the running thread by the reciprocating thread guide and said spiral grooves of said rotating, cylindrical, traverse roller, said thread guide being reciprocably driven by drive means embodying a cross-spiral grooved roller, the groove of which at the stroke ends having before and/or after the stroke reversal point a pitch angle greater than the pitch angle in said mid-range and also a greater radius of curvature at said stroke ends.

5. A high speed winding apparatus as claimed in claim 1 wherein the walls of said spiral grooves and said cylindrical surface of said roller have a matte finish with a depth of roughening in said matte finish of about 1.5 to 40 microns.

6. A high speed winding apparatus as claimed in claim 5 wherein said depth of roughening is about 3 to 10 microns.

7. A high speed winding apparatus as claimed in claim 1 wherein said spiral grooves respectively begin at the cylindrical surface of the longitudinal mid-portion of said roller and end on the cylindrical surface of said roller at said point laterally displaced from the longitudinal mid-portion of said roller.

8. A high speed winding apparatus comprising a traverse device, said traverse device being a rotably driven, cylindrical, traverse roller with spiral grooves in the cylindrical surface thereof, said spiral grooves being of opposite hand for guiding the thread in traverse strokes thereof and having stroke reversal zones at respective opposite ends of the roller, the spiral grooves having a variable depth which increases progressively from a shallowest segment at or below the surface of the roller in the longitudinal mid-portion of the roller to a point of maximum depth preceding the point of stroke reversal of the respective stroke reversal zones, which depth then decreases from said first-mentioned point to a second point preceding said point of stroke reversal, then again increases to a point substantially at the point of stroke reversal, and then again decreases to a shallowest groove depth in the longitudinal mid-portion of said roller.

9. A high speed winding apparatus as claimed in claim 8, said spiral grooves being continuous, crossing grooves having their shallowest segments at the longitudinal mid-portion of said roller.

10. A high speed winding apparatus as claimed in claim 8, embodying in combination with said traverse device another traverse device having a reciprocable guide for guiding the thread in traversing winding strokes, the latter traverse device being the first traverse device through which the thread runs, and means for reciprocably driving said thread guide to provide reciprocable movement of the guided, running thread in leading relationship to the reciprocable movement of the thread in said spiral grooves to provide a lag angle to lay the thread at proper angles for guidance in the respective portion of the spiral groove in which the thread is positioned at any given time during the traverse movement of the running thread by the reciprocating thread guide and said spiral grooves of said rotating, cylindrical, traverse roller.

11. A high speed winding apparatus as claimed in claim 8, embodying in combination with said traverse device another traverse device having a reciprocable thread device for guiding the thread in traversing winding strokes, the latter traverse device being the first traverse device through which the thread runs, and means for reciprocably driving said thread guide to provide reciprocable movement of the guided, running thread in leading relationship to the reciprocable movement of the thread in said spiral grooves to provide a lag angle to lay the thread at proper angles for guidance in the respective portion of the spiral groove in which the thread is positioned at any given time during the traverse movement of the running thread by the reciprocating thread guide and said spiral grooves of said rotating, cylindrical, traverse roller, said thread guide being reciprocably driven by drive means embodying a cross-spiral grooved roller, the groove of which at the stroke ends having before and/or after the stroke reversal point a pitch angle greater than the pitch angle in said mid-range and also a greater radius of curvature at said stroke ends.

12. A high speed winding apparatus as claimed in claim 11 wherein the walls of said spiral grooves and said cylindrical surface of said roller have a matte finish with a depth of roughening in said matte finish of about 1.5 to 40 microns.

13. A high speed winding apparatus as claimed in claim 12 wherein said depth of roughening is about 3 to 10 microns.

14. A high speed winding apparatus as claimed in claim 8 wherein said spiral grooves respectively being at the cylindrical surface of the longitudinal mid-portion of said roller and end on the cylindrical surface of said roller at said point laterally displaced from the longitudinal mid-portion of said roller.

* * * * *